US012528157B2

(12) United States Patent
Gehrmann et al.

(10) Patent No.: US 12,528,157 B2
(45) Date of Patent: Jan. 20, 2026

(54) GRINDING DISC AND USE OF SUCH A GRINDING DISC

(71) Applicant: PFERD MILWAUKEE BRUSH COMPANY, INC., Milwaukee, WI (US)

(72) Inventors: Stefan Gehrmann, Marienheide (DE); Frank Henn, Marienheide (DE); Achim Schmitz, Marienheide (DE); Fabian Schumacher, Engelskirchen (DE)

(73) Assignee: PFERD MILWAUKEE BRUSH COMPANY, INC., Milwaukee, WI (US)

( * ) Notice: Subject to any disclaimer, the term of this patent is extended or adjusted under 35 U.S.C. 154(b) by 864 days.

(21) Appl. No.: 17/422,633

(22) PCT Filed: Jan. 14, 2019

(86) PCT No.: PCT/EP2019/050836
§ 371 (c)(1),
(2) Date: Jul. 13, 2021

(87) PCT Pub. No.: WO2020/147922
PCT Pub. Date: Jul. 23, 2020

(65) Prior Publication Data

US 2022/0088747 A1 Mar. 24, 2022

(51) Int. Cl.
*B24D 5/04* (2006.01)
*B24D 7/04* (2006.01)

(52) U.S. Cl.
CPC ..... *B24D 5/04* (2013.01); *B24D 7/04* (2013.01)

(58) Field of Classification Search
CPC . B24D 3/007; B24D 3/28; B24D 3/30; B24D 3/001; B24D 5/04; B24D 7/08;
(Continued)

(56) References Cited

U.S. PATENT DOCUMENTS

RE25,303 E * 12/1962 Erickson ..... B24D 5/04 51/297
3,526,063 A * 9/1970 Cook ..... B24D 5/04 451/546

(Continued)

FOREIGN PATENT DOCUMENTS

AT 194274 B 1/1958
AT 09124 U1 5/2007

(Continued)

OTHER PUBLICATIONS

TW-558155-U translation (Year: 2018).*

(Continued)

*Primary Examiner* — David S Posigian
*Assistant Examiner* — Steven Huang
(74) *Attorney, Agent, or Firm* — FISHERBROYLES, LLP; Roger L. Browdy; Ronni S. Jillions

(57) ABSTRACT

A grinding disc comprises a grinding layer formed of grinding grains bound by means of a binding agent. Reinforcing fabrics are embedded in the grinding layer on the outer sides of the grinding layer. At least one additional fabric is arranged on at least one of the reinforcing fabrics and has a respective diameter which is smaller than the diameter of the rein-forcing fabrics. The at least one additional fabric stiffens the grinding disc in a region around a central opening and improves the properties of the grinding disc during rough machining and/or cutting off.

23 Claims, 4 Drawing Sheets

(58) Field of Classification Search
CPC ..... B24D 7/04; B24D 13/08; B24D 11/02; B24D 18/0027; B24B 23/022
USPC ..... 451/534, 532, 546; 51/295
See application file for complete search history.

(56) References Cited

U.S. PATENT DOCUMENTS

| | | | | |
|---|---|---|---|---|
| 2005/0107020 | A1* | 5/2005 | Lang | B24D 5/12 451/544 |
| 2014/0137482 | A1* | 5/2014 | Li | B24D 5/04 51/309 |
| 2015/0079887 | A1* | 3/2015 | Nie | B24D 3/20 451/540 |
| 2015/0196992 | A1* | 7/2015 | Ficai | B24D 3/002 51/293 |
| 2016/0184976 | A1* | 6/2016 | Pacella | B24D 3/005 51/298 |

FOREIGN PATENT DOCUMENTS

| | | | | |
|---|---|---|---|---|
| CN | 103878706 | A * | 6/2014 | B24D 18/0009 |
| EP | 0355732 | A2 * | 2/1990 | B24D 5/04 |
| EP | 0703851 | B1 * | 3/1999 | |
| EP | 1543923 | A1 | 6/2005 | |
| JP | 56-152584 | A | 11/1981 | |
| JP | 2001-315063 | A | 11/2001 | |
| JP | 2002 154 052 | A | 5/2002 | |
| TW | 558155 | U * | 4/2018 | |
| TW | M558155 | U * | 4/2018 | |
| WO | 2010078191 | A2 | 7/2010 | |
| WO | 2015040083 | A1 | 3/2015 | |
| WO | 2018036616 | A1 | 3/2018 | |

OTHER PUBLICATIONS

CN-103878706-A translation (Year: 2014).*
Translation of TW M558155 U (Year: 2018).*
Translation of EP 0355732 A2 (Year: 1990).*
Office Action dated Jan. 17, 2023, from corresponding Brazilian Action patent application No. BR1120210135723, with English translation.
Office Action dated Feb. 26, 2023, from corresponding Chinese patent application No. 2019 8008 8937.X, with English translation.
Office Action dated Mar. 9, 2023, from corresponding Colombian patent application No. NC 2021/0009001, with English translation.
Office Action dated Nov. 30, 2022, from corresponding Indian patent application No. 2021 1703 0064.
Office Action dated May 5, 2023, from corresponding Japanese patent application No. 2021-540 573, with English translation.
Korean Office Action for corresponding patent application No. 10-2021-7023364 dated Jan. 14, 2023 and English Translation.
Office Action dated Sep. 23, 2022, from corresponding Chilean patent application No. 2021 01824.
Office Action dated Feb. 2, 2023, from corresponding Indonesian patent application No. P00202106285.
Office Action dated Apr. 11, 2025 for MX/a/2021/008309.

* cited by examiner

GRINDING DISC AND USE OF SUCH A GRINDING DISC

FIELD OF THE INVENTION

The invention relates to a grinding disc. Furthermore, the invention relates to the use of such a grinding disc for rough machining and/or cutting off.

BACKGROUND OF THE INVENTION

From EP 1 543 923 A1 a grinding disc is known which is used for rough machining by means of a hand-guided angle grinding machine. The grinding disc comprises a grinding layer formed of abrasive grains bonded by means of a binding agent and reinforced by means of inner and outer reinforcing fabrics.

SUMMARY OF THE INVENTION

It is an object of the invention to create a grinding disc that has improved properties during rough machining and/or cutting off. In particular, the grinding disc shall be usable at higher rotational speeds and a higher cutting speed and achieve a higher grinding performance and/or cutting-off performance. Furthermore, the grinding disc shall be usable for rough machining and for cutting off.

This task is solved by a grinding disc comprising a grinding layer, which is formed of grinding grains bound by means of a binding agent, which has a grinding layer diameter $D_S$, which forms a first outer side and a second outer side, a first reinforcing fabric, which is embedded in the grinding layer on the first outer side, which has a first fabric diameter $D_{A1}$, wherein: $D_{A1} \geq 0.8 \cdot D_S$, a second reinforcing fabric, which is embedded in the grinding layer on the second outer side, which has a second fabric diameter $D_{A2}$, wherein: $D_{A2} \geq 0.8 \cdot D_S$, wherein at least one fabric is arranged on at least one of the reinforcing fabrics, and wherein the at least one fabric has a respective diameter $D_i$, wherein: $D_i < D_{A1}$ and $D_i < D_{A2}$. The grinding disc comprises a central opening for attaching a grinding machine. By arranging at least one additional fabric or at least one stiffening fabric on at least one of the reinforcing fabrics, each of which has a smaller diameter $D_i$ than the reinforcing fabrics, the grinding disc is stiffened and stabilized in the region around the central opening. Due to the at least one additional fabric, the number and/or the weight, in particular the glass weight, of inner reinforcing fabrics lying in the grinding layer can be reduced without affecting the stiffness and stability of the grinding disc. The at least one fabric is arranged on a side of the at least one reinforcing fabric facing the grinding layer and/or on a side of the at least one reinforcing fabric facing away from the grinding layer. If several fabrics are arranged on one of the reinforcing fabrics or a respective reinforcing fabric, these fabrics are thus arranged on a side of the reinforcing fabric or the respective reinforcing fabric facing the grinding layer and/or on a side of the reinforcing fabric facing away from the grinding layer. The fabrics associated with a reinforcing fabric are accordingly arranged on the side facing towards and/or the side facing away from the grinding layer. The at least one fabric is in particular arranged concentrically to an axis of rotation of the grinding disc and/or to the central opening. In particular, the at least one fabric is arranged immediately adjacent to the at least one reinforcing fabric. Preferably, the at least one fabric abuts the at least one reinforcing fabric. By reducing the number and/or the weight, in particular the glass weight, of the reinforcing fabrics in the grinding layer and/or in the working region of the grinding disc, the grinding performance and/or cutting-off performance during rough machining and/or cutting off is improved. Furthermore, it is possible to use the grinding disc at comparatively higher rotational speeds, so that the grinding performance and/or cutting-off performance during rough machining and/or cutting off is additionally improved. The grinding disc is configured in a straight or cranked manner.

The at least one additional fabric reinforces the central region around the central opening so that the number of reinforcing fabrics having a fabric diameter substantially corresponding to the grinding layer diameter $D_S$ is reduced. The reduced proportion or number of reinforcing fabrics in the working region of the grinding disc improves the properties, in particular the grinding performance and/or the cutting-off performance, of the grinding disc during rough machining and/or cutting off.

The first reinforcing fabric and/or the second reinforcing fabric is construed in particular as a glass fiber fabric. Preferably, the following applies to the first fabric diameter $D_{A1}$:$D_{A1} \geq 0.9 \cdot D_S$, in particular $D_{A1} \geq 0.95 \cdot D_S$, and in particular $D_{A1} \geq 0.99 \cdot D_S$. Furthermore, the following preferably applies to the second fabric diameter $D_{A2}$:$D_{A2} \geq 0.9 \cdot D_S$, in particular $D_{A2} \geq 0.95 \cdot D_S$, and in particular $D_{A2} \geq 0.99 \cdot D_S$. In particular, the following applies: $D_{A1} = D_{A2} = D_S$.

The at least one fabric is formed identically and/or differently to the first reinforcing fabric and/or the second reinforcing fabric. The at least one fabric has a smaller mesh size, a larger mesh size and/or the same mesh size as the first reinforcing fabric and/or the second reinforcing fabric. A plurality of fabrics is formed identically and/or differently. In particular, the at least one fabric is formed as a glass fiber fabric. The index i designates the respective fabric and $D_i$ the diameter of the respective fabric. The number of fabrics arranged on the first reinforcing fabric is equal to or different from the number of fabrics arranged on the second reinforcing fabric.

Due to the reduced number of and/or the reduced weight, in particular glass weight, of reinforcing fabrics lying in the grinding layer, a grinding disc intended for rough machining can in particular be formed with a comparatively smaller thickness so that it is also suitable for cutting off and has a good cutting-off performance.

Due to the at least one additional fabric and the higher stiffness, a vibration or fluttering of the grinding disc and thus an uneven cut is avoided, in particular with a grinding disc intended for cutting off. This and the use at comparatively higher rotational speeds considerably improve the cutting-off performance. Furthermore, the grinding disc enables curved cuts, as the at least one additional fabric protects at least one of the reinforcing fabrics from excessive deformation in the region of the central opening due to bending at fastening means, for example a nut, of an angle grinding machine.

A grinding disc configured such that the grinding layer between the reinforcing fabrics is free of reinforcing fabrics ensures improved properties during rough machining and/or cutting off. Due to the fact that the grinding layer does not have a reinforcing fabric lying within the grinding layer, i.e. no central reinforcing fabric, between the reinforcing fabrics arranged on the outer sides, the proportion of reinforcing fabric in the working region of the grinding disc is low. An internal reinforcing fabric is understood to be a reinforcing fabric which is arranged between the first reinforcing fabric and the second reinforcing fabric and which has a fabric diameter of at least $0.8 \cdot D_S$. In the at least one grinding layer, at least one fabric with the diameter $D_i$ may be arranged, which is arranged at a distance from the reinforcing fabrics, in particular centrally with respect thereto. Preferably, the grinding layer between the reinforcing fabrics is free of fabric, so that neither a reinforcing fabric nor an additional fabric is arranged between the first reinforcing fabric and the second reinforcing fabric.

A grinding disc configured such that the at least one fabric is arranged relative to the at least one reinforcing fabric on a side facing away from the grinding layer ensures improved properties during rough machining and/or cutting off. Due to the fact that the at least one fabric is arranged on a side of the at least one reinforcing fabric facing away from the grinding layer, the grinding disc is stiffened on the one hand and the at least one reinforcing fabric is protected by the at least one fabric on the other hand.

A grinding disc configured such that at least one fabric is arranged on the first reinforcing fabric and at least one fabric is arranged on the second reinforcing fabric ensures improved properties during rough machining and/or cutting off. By arranging at least one fabric on the first reinforcing fabric and on the second reinforcing fabric, the grinding disc is reinforced and stiffened on both outer sides. The at least one fabric is arranged on a side facing away from the grinding layer and/or on a side facing the grinding layer of the first reinforcing fabric or the second reinforcing fabric.

A grinding disc configured such that a plurality of fabrics are arranged on at least one of the reinforcing fabrics ensures improved properties during rough machining and/or cutting off. Preferably, a plurality of fabrics is arranged on the first reinforcing fabric and a plurality of fabrics is arranged on the second reinforcing fabric. Preferably, the plurality of fabrics is arranged exclusively on a side of the first reinforcing fabric and/or the second reinforcing fabric facing away from the grinding layer.

A grinding disc configured such that the following applies for the respective diameter $D_i$: $0.25 \cdot D_S \leq D_i \leq 0.75 \cdot D_S$, in particular $0.3 \cdot D_S \leq D_i \leq 0.7 \cdot D_S$, and in particular $0.35 \cdot D_S \leq D_i \leq 0.65 \cdot D_S$, ensures improved properties during rough machining and/or cutting off. The respective diameter $D_i$ ensures that the respective fabric stiffens a clamping region or the central region around the central opening and does not substantially extend into an outer working region. Preferably, all fabrics have the same diameter $D_i$.

A grinding disc configured such that the at least one fabric is arranged in a clamping region and/or outside an outer working region, which is usable for cutting off, and/or in an inner working region, which is usable for rough machining, of the grinding disc ensures improved properties during rough machining and/or cutting off. The at least one fabric is arranged in the clamping region and reinforces it around the central opening. The at least one fabric is in particular not arranged in an outer working region usable for cutting off. In particular, the at least one fabric is arranged in an inner working region usable for rough machining. Preferably, the grinding disc comprises a clamping region, an inner working region and an outer working region. The inner working region is arranged in the radial direction between the clamping region and the outer working region. The at least one fabric preferably extends in the clamping region and at least partially in the inner working region, whereas the at least one fabric does not extend in the outer working region. This stiffens the clamping region. Rough machining is performed with the inner working region and/or the outer working region with a high grinding performance. Cutting off is done with the outer working region with a high cutting-off performance. The inner working region and the outer working region are predetermined, for example, by an angle head of an angle grinding machine, which prevents the grinding disc from being used for cutting off in the inner working region.

A grinding disc configured such that the at least one fabric delimits a reinforced region of the grinding disc with a thickness $d_1$ and an unreinforced region of the grinding disc with a thickness $d_2$, wherein the following applies: $0.95 \leq d_1/d_2 \leq 1.05$, in particular $0.99 \leq d_1/d_2 \leq 1.01$, and in particular $0.995 \leq d_1/d_2 \leq 1.005$, ensures improved properties during rough machining and/or cutting off. By the grinding disc having a substantially uniform thickness d over the entire grinding layer diameter $D_S$, the working region of the grinding disc is not affected. Preferably, $d_1 = d_2 = d$, wherein d denotes the uniform thickness of the grinding layer in the working region.

A grinding disc comprising a thickness d, wherein the following applies: 2 mm≤d≤7 mm, in particular 3 mm≤d≤6 mm, and in particular 4 mm≤d≤5 mm, ensures improved properties during rough machining and/or cutting off. Due to the thickness d of the grinding disc in the working region, the grinding disc intended for rough machining is also suitable for cutting off. The grinding disc thus has a high grinding performance during rough machining and high cutting-off performance during cutting off. The roughing grinding disc can therefore also be used for cutting off.

A grinding disc comprising a thickness d, wherein the following applies: 0.8 mm≤d≤4 mm, in particular 1.2 mm≤d≤3.2 mm, and in particular 1.6 mm≤d≤2.5 mm, ensures improved properties during cutting off. The grinding disc intended for cutting off can be used at a comparatively high rotational speed and thus a high cutting speed, so that the cutting-off performance is improved. The grinding disc is thus used in particular as a cutting-off grinding disc. The grinding disc can also be used for rough machining.

A grinding disc configured such that the at least one fabric, which is assigned to one of the reinforcing fabrics has, in total, a respective weight per unit area $G_j$, wherein the following applies: 50 g/m²≤$G_j$≤500 g/m², in particular 75 g/m²≤$G_j$≤450 g/m², and in particular 100 g/m²≤$G_j$≤400 g/m², ensures improved properties during rough machining and/or cutting off. A higher weight per unit area $G_j$ of the at least one fabric increases the stability and stiffness of the grinding disc. However, the weight per unit area $G_j$ is sufficiently low to avoid a deterioration of the grinding performance or cutting-off performance due to the fabric content. The weight per unit area $G_j$ is determined per side, i.e. per reinforcing fabric, and for the fabrics arranged on the respective reinforcing fabric. If only one fabric is arranged on one of the reinforcing fabrics or on one side, the weight per unit area $G_j$ corresponds to the weight per unit area of this fabric. If, on the other hand, a plurality of fabrics is arranged on one of the reinforcing fabrics, the weight per unit area $G_j$ is the sum of the weights per unit area of these fabrics. For example, if two fabrics are arranged on the first reinforcing fabric and two fabrics are arranged on the second reinforcing fabric, a first weight per unit area is determined as the sum of the weights per unit area of the fabrics arranged on the first reinforcing fabric and a second weight per unit area is determined as the sum of the weights per unit area of the fabrics arranged on the second reinforcing fabric. The respective summed weight per unit area lies in the stressed region. For example, the following applies to the respective summed weight per unit area $G_j$ of the at least one fabric associated with the first reinforcing fabric or the second reinforcing fabric: 150 g/m²≤$G_j$≤350 g/m², in particular 250 g/m$^2$≤$G_j$≤300 g/m$^2$. The index j designates the respective reinforcing fabric to which the at least one fabric is associated.

A grinding disc configured such that the at least one fabric has a respective thread width $b_i$, wherein the following applies: 0.1 mm≤$b_i$≤1.8 mm, in particular 0.3 mm≤$b_i$≤1.5 mm, and in particular 1 mm≤$b_i$≤1.2 mm, ensures improved properties during rough machining and/or cutting off. A higher thread width $b_i$ of the at least one fabric increases the stability and stiffness of the grinding disc. However, the thread width is sufficiently low to allow the respective fabric to be embedded in the grinding layer or grinding disc at the associated reinforcing fabric. The index i designates the respective fabric.

A grinding disc configured such that the at least one fabric has a respective value $R_i$, wherein the following applies: 0.2≤$R_i$≤1.2, in particular 0.3≤$R_i$≤1, ensures improved properties during rough machining and/or cutting off. The value $R_i$ is a measure of the openness of the respective fabric. The index i designates the respective fabric. A higher value $R_i$ increases the stability and stiffness of the grinding disc. However, the value $R_i$ is sufficiently low to allow the respective fabric to be embedded in the grinding disc. The grinding performance or cutting-off performance is not affected by the amount of fabric in the working region of the grinding disc. The following applies to $R_i$:

$$R_i=R_{xi}+R_{yi},$$

with $$R_{xi}=b_{xi}\cdot n_{xi}/l_{xi},$$

$$R_{yi}=b_{yi}\cdot n_{yi}/l_{yi},$$

wherein $b_{xi}$, $b_{yi}$ is a thread width or a web width of the threads in x-direction and ydirection, respectively, $n_{xi}$, $n_{yi}$ is a number of threads or a number of webs in the x-direction and the y-direction, respectively, $l_{xi}$, $l_{yi}$ is a length in the x-direction and the y-direction.

A grinding disc comprising a clamping ring for clamping the grinding disc on a grinding machine ensures improved properties during rough machining and/or cutting off. The clamping ring forms the central opening. The clamping ring or the associated hole is generated by a bolt of a torch stand during the flow of the binding agent, in particular the resin. The clamping ring additionally strengthens and stiffens the clamping region and/or the central opening. The clamping ring is in particular construed as a steel ring.

It is one further object of the invention to enable the use of a grinding disc with improved properties during rough machining and/or cutting off.

This object is achieved by using the grinding disc for rough machining and/or for cutting off, wherein a cutting speed is at least 80 m/s, in particular at least 90 m/s, and in particular at least 100 m/s. Preferably, the grinding disc is used for rough machining and for cutting off. Due to the improved stability, the grinding disc can be used at higher rotational speeds and higher cutting speeds. This increases the grinding performance or cutting-off performance. With regard to the further advantages in the use of the grinding disc, reference is made to the advantages of the grinding disc according to the invention already described.

Further features, advantages and details of the invention will be apparent from the following description of an embodiment.

DESCRIPTION OF THE PREFERRED EMBODIMENT

Figure 1:
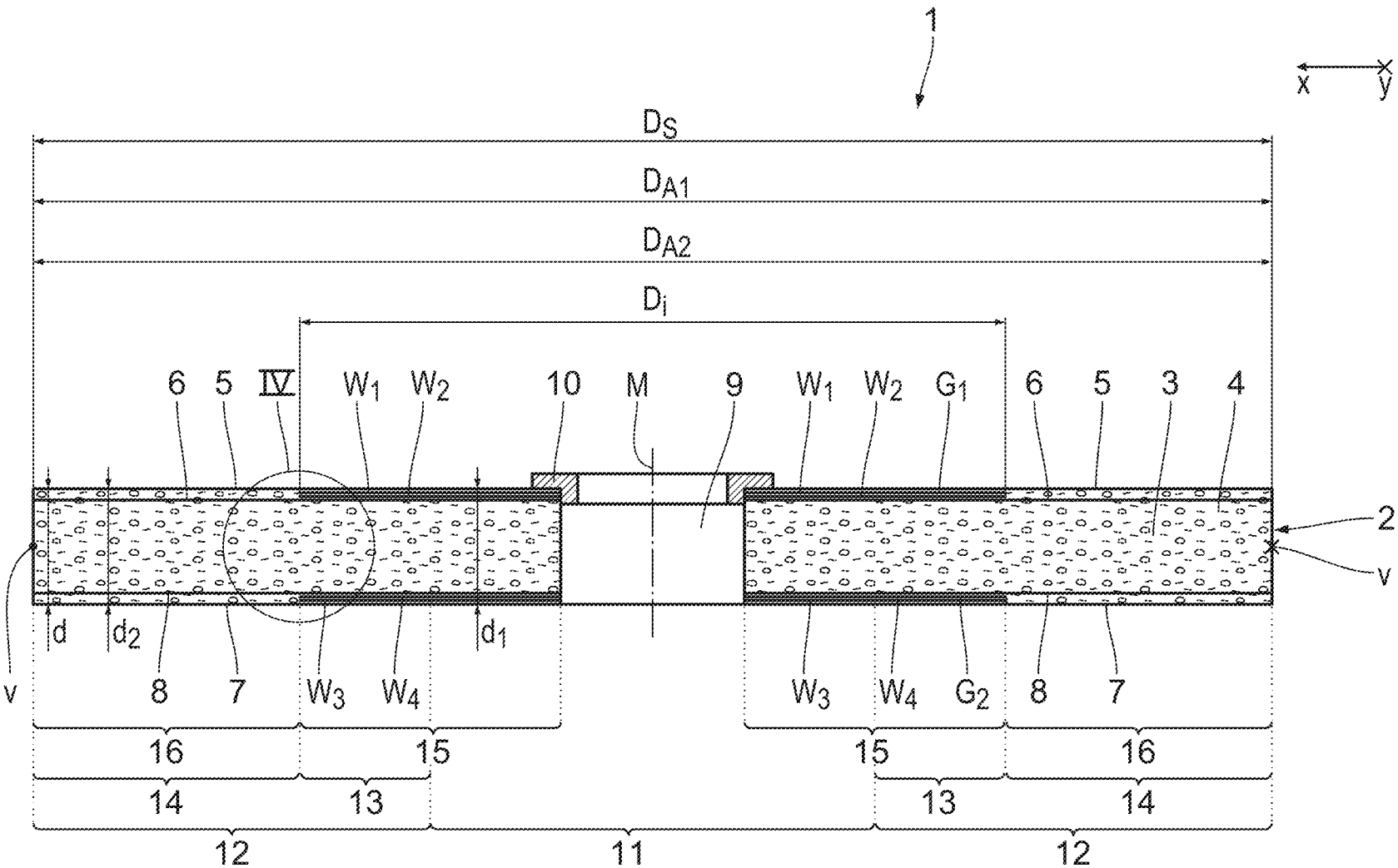
FIG. 1 shows a sectional view of a grinding disc according to the invention with reinforcing fabrics and additional fabrics.
Figure 2:
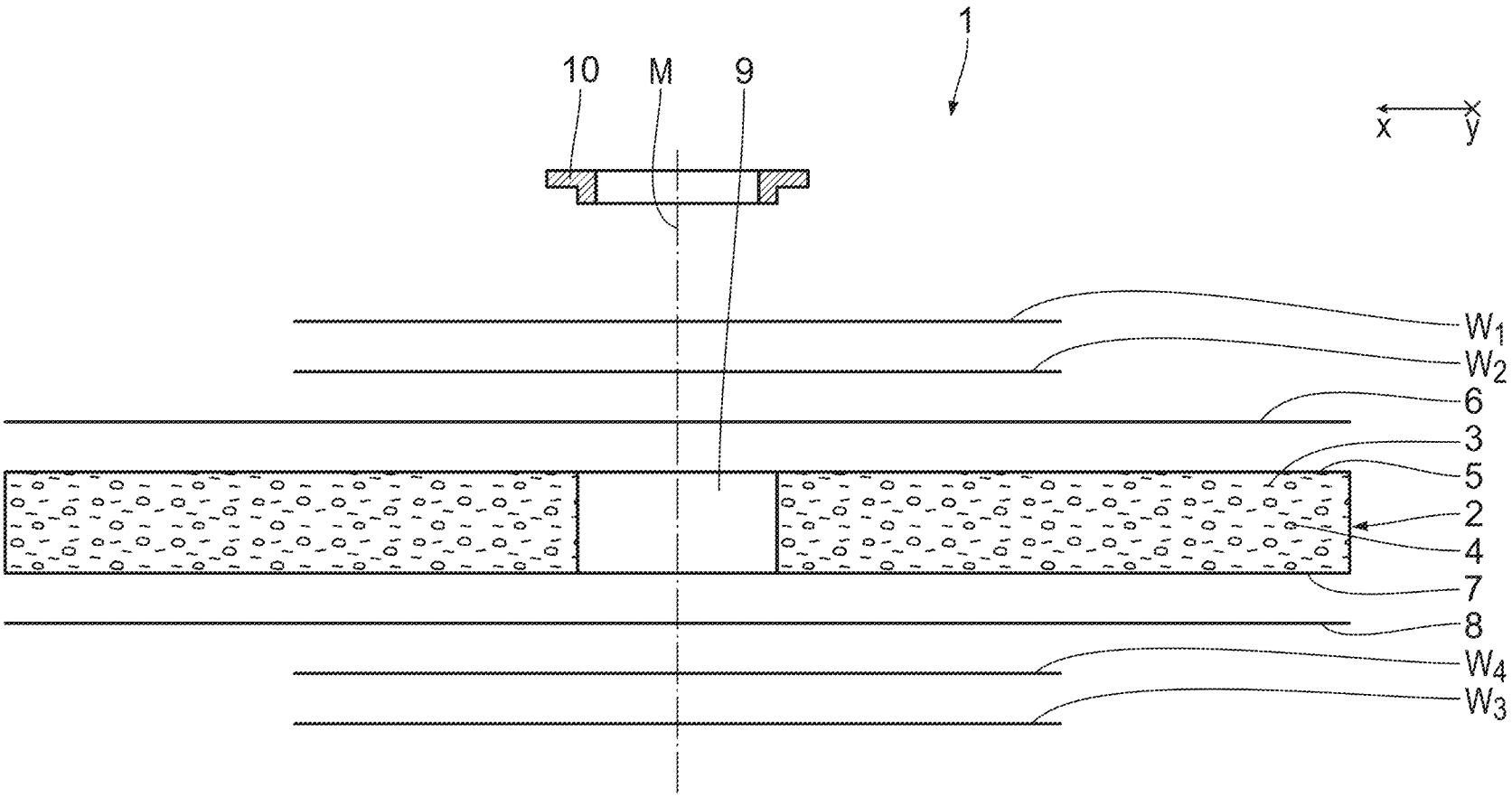
FIG. 2 shows an exploded view of the grinding disc in FIG. 1.

The grinding disc 1 shown in FIG. 1 is for the use on a hand-held angle grinder. The grinding disc 1 comprises a grinding layer 2, which is formed of grinding grains 4 bonded by means of a binding agent 3. The binding agent 3, for example, is a phenolic resin. The grinding layer 2 has a grinding layer diameter $D_S$ which corresponds to a nominal diameter of the grinding disc 1.

A first reinforcing fabric 6 is embedded in the grinding layer 2 on a first outer side 5. Correspondingly, a second reinforcing fabric 8 is embedded in the grinding layer 2 on a second outer side 7. The first reinforcing fabric 6 has a first fabric diameter $D_{A1}$, which corresponds to the grinding layer diameter $D_S$. Correspondingly, the second reinforcing fabric 8 has a second fabric diameter $D_{A2}$, which corresponds to the grinding layer diameter $D_S$.

The reinforcing fabrics 6, 8 are construed as glass fiber fabrics, for example.

The grinding disc 1 comprises additional fabrics $W_1$, $W_2$, $W_3$ and $W_4$. The fabrics $W_1$ and $W_2$ are arranged on a side of the first reinforcing fabric 6 facing away from the grinding layer 2 and are embedded in the grinding layer 2, whereas the fabrics $W_3$ and $W_4$ are arranged on a side of the second reinforcing fabric 8 facing away from the grinding layer 2 and are embedded in the grinding layer 2.

Figure 4:
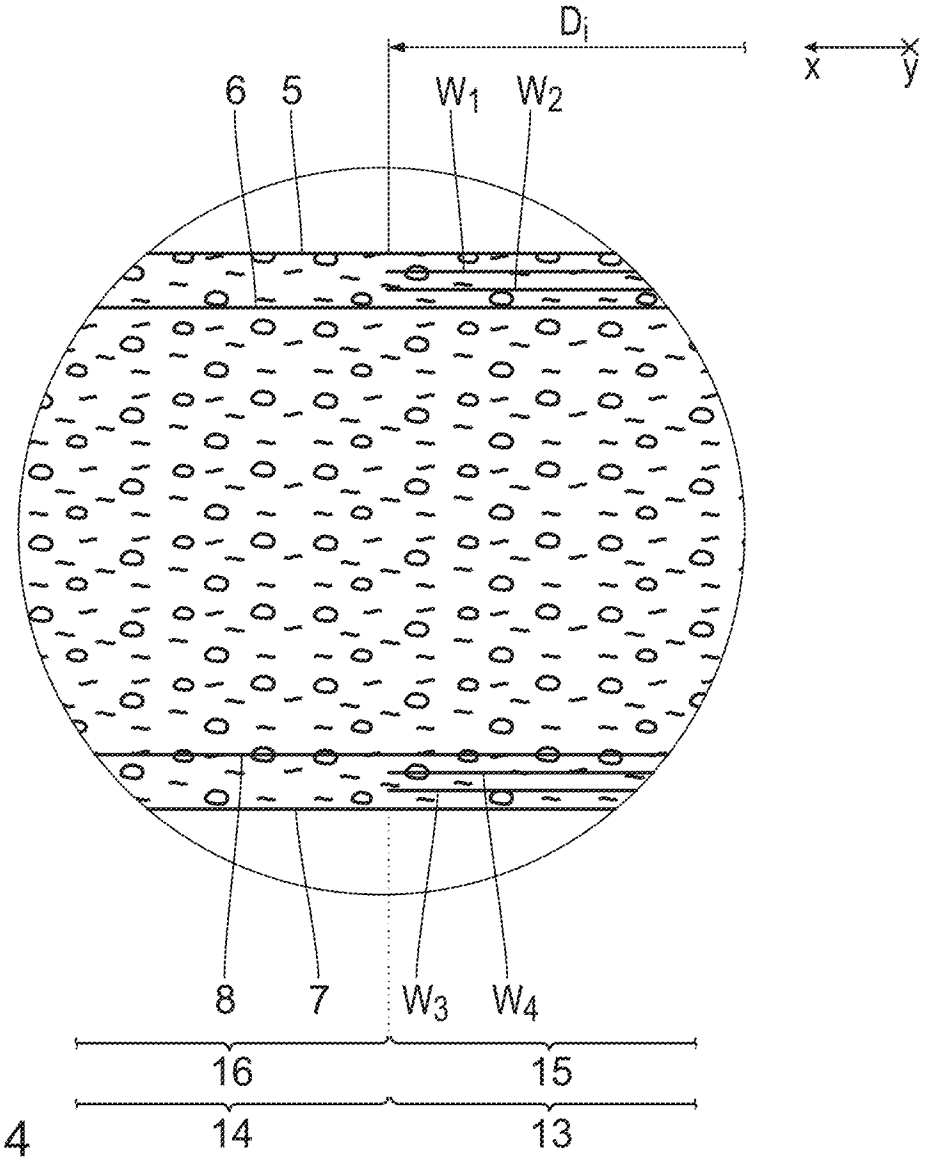
FIG. 4 shows an enlarged view of a portion IV of the grinding disc in FIG. 1.

FIG. 4 shows an enlarged view of the portion IV of FIG. 1. This view shows that a first reinforcing fabric 6 is embedded inside the first outer side of the grinding layer such that the first outer side comprises a first surface of the grinding disc, a second reinforcing fabric 8 is embedded inside the second outer side of the grinding layer such that the second outer side comprises a second surface of the grinding disc, and at least one fabric (of fabrics $W_1$, $W_2$, $W_3$ and $W_4$) is embedded in the grinding layer between the first outer side and the second outer side.

The grinding disc 1 comprises a central opening 9 for attachment to an angle grinding machine. The central opening 9 defines an axis of rotation M of the grinding disc 1. For clamping to an angle grinding machine, the grinding disc 1 has a clamping ring 10 which is arranged in the central opening 9. The clamping ring 10, for example, is construed as a steel ring. The clamping ring 10 abuts the fabric $W_1$ on the first outer side 5 and is connected to the grinding layer 2.

The grinding disc 1 is circular in shape. The reinforcing fabrics 6, 8 and/or the fabrics $W_1$ to $W_4$ are arranged concentrically to the axis of rotation M. The reinforcing fabrics 6, 8 and/or the fabrics $W_1$ to $W_4$ are annular.

The fabrics $W_1$ to $W_4$ have a respective diameter $D_1$ to $D_4$. The fabrics are generally designated $W_i$ and the corresponding diameter $D_i$ with i=1, 2, 3, 4. The index i specifies the respective fabric $W_i$. The following applies to the respective diameter $D_i$:$D_i$<$D_{A1}$ and $D_i$<$D_{A2}$. In particular, the following applies to the respective diameter $D_i$: $0.25 \cdot D_S \leq D_i \leq 0.75 \cdot D_S$, in particular $0.3 \cdot D_S \leq D_i \leq 0.7 \cdot D_S$, and in particular $0.35 \cdot D_S \leq D_i \leq 0.65 \cdot D_S$. Preferably, $D_1 = D_2 = D_3 = D_4$.

The grinding layer 2 is free of further reinforcing fabrics between the reinforcing fabrics 6, 8, so that the grinding layer 2 is in particular free of a reinforcing fabric arranged centrally in the grinding layer 2. Preferably, the grinding layer 2 is also free of further additional fabrics between the reinforcing fabrics 6, 8.

The grinding disc 1 forms a clamping region 11 in the radial direction to the axis of rotation M and a working region 12 surrounding the clamping region 11. The working region 12 is divided in the radial direction to the axis of rotation M into an inner working region 13 and an outer working region 14 surrounding it. The working region 12, i.e. the inner working region 13 and the outer working region 14, are annular. The inner working region 13 extends in the radial direction as far as the fabrics $W_1$ to $W_4$ extend. The clamping region 11 and the inner working region 13 thus form a reinforced region 15 in which the fabrics $W_1$ to $W_4$ are arranged. The outer working region 14, on the other hand, forms an unreinforced region 16 which is free of additional fabrics $W_1$ to $W_4$. The outer working region 14 is preferably used for cutting off a workpiece, whereas the inner working region 13 and the outer working region 14 are used for rough machining a workpiece.

The reinforced region 15 has a thickness $d_1$, whereas the unreinforced region 16 has a thickness $d_2$. The grinding disc 1 has a substantially constant thickness in the radial direction to the axis of rotation M, wherein: $0.95 \leq d_1/d_2 \leq 1.05$, in particular $0.99 \leq d_1/d_2 \leq 1.01$, and in particular $0.995 \leq d_1/d_2 \leq 1.005$. A thickness d of the grinding disc 1 results from the maximum of the thicknesses $d_1$ and $d_2$. Preferably, the following applies: $d = d_1 = d_2$.

In a preferred use of the grinding disc 1 for rough machining a workpiece, the following preferably applies to the thickness d: 2 mm≤d≤7 mm, in particular 3 mm≤d≤6 mm, and in particular 4 mm≤d≤5 mm. In a preferred use of the grinding disc 1 for cutting off a workpiece, the following preferably applies for the thickness d: 0.8 mm≤d≤4 mm, in particular 1.2 mm≤d≤3.2 mm, and in particular 1.6 mm≤d≤2.5 mm.

Figure 3:
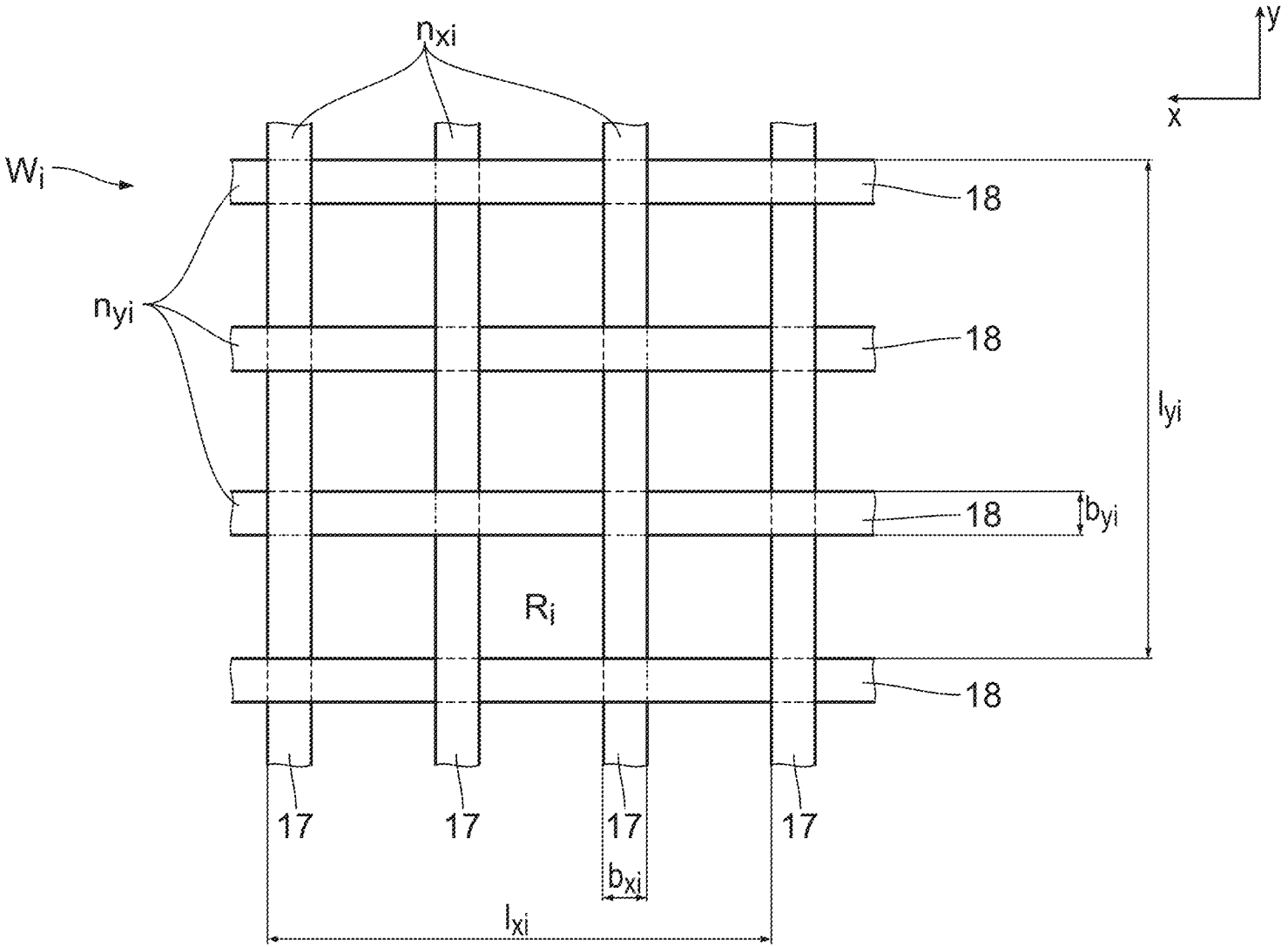
FIG. 3 shows an enlarged top view of an additional fabric.

FIG. 3 illustrates in general the structure of a fabric $W_i$. The fabric $W_i$ has a plurality of weft threads 17 running in a y-direction and a plurality of warp threads 18 running transversely thereto in an x-direction. The respective fabric $W_i$ is construed as a glass fibre fabric, for example.

The weft threads 17 have a thread width $b_{xi}$, whereas the warp threads 18 have a thread width $b_{yi}$. The thread width $b_{xi}$ or $b_{yi}$ is also referred to as the web width. For the thread width $b_{xi}$, the following preferably applies: 0.1 mm≤$b_{xi}$≤1.8 mm, in particular 0.3 mm≤$b_{xi}$≤1.5 mm, and in particular 1 mm≤$b_{xi}$≤1.2 mm. For the thread width $b_{yi}$, the following preferably applies: 0.1 mm≤$b_{yi}$≤1.8 mm, in particular 0.3 mm≤$b_{yi}$≤1.5 mm, and in particular 1 mm≤$b_{yi}$≤1.2 mm. The thread widths $b_{xi}$ and $b_{xi}$ are generally referred to as thread width $b_i$. The thread widths $b_{xi}$ and $b_{yi}$ of the respective fabric W; may be the same and/or different. Furthermore, the thread widths $b_{xi}$ and $b_{yi}$ of the fabrics $W_i$ can be the same among each other and/or be different from each other.

The respective fabric W has a value $R_i$ which characterizes the openness of the fabric $W_i$. The following applies to the respective value $R_i$:

$$R_i = R_{xi} + R_{yi} \tag{1}$$

with $$R_{xi} = b_{xi} \cdot n_{xi} / l_{xi} \tag{2}$$

and $$R_{yi} = b_{yi} \cdot n_{yi} / l_{yi} \tag{3}$$

In equations (2) and (3):

$b_{xi}$ denotes the thread width of the weft threads 17, $n_{xi}/l_{xi}$ denotes the number of weft threads 17 in relation to a length $l_{xi}$ in the x-direction, $b_{yi}$ denotes the thread width of the warp threads 18, $n_{yi}/l_{yi}$ denotes a number of warp threads 18 in relation to a length $l_{yi}$ in the y-direction.

The values $R_{xi}$ and $R_{yi}$ of the respective fabric $W_i$ can be the same or different. The values $R_{xi}$ and $R_{yi}$ of the fabrics $W_i$ can be the same among each other and/or different. The values $R_i$ of the fabrics $W_i$ can be the same and/or different. The following preferably applies to the values $R_i$: $0.2 \leq R_i \leq 1.2$, in particular $0.3 \leq R_i \leq 1$.

The fabrics $W_1$ and $W_2$ are associated to the first reinforcing fabric 6 and have a total first weight per unit area $G_1$. Correspondingly, the fabrics $W_3$ and $W_4$ are associated to the second reinforcing fabric 8 and have a total second weight per unit area $G_2$. The respective weight per unit area is generally denoted by $G_j$, wherein the index j denotes the respective reinforcing fabric 6, 8 or the respective outer side of the grinding layer 2 to which the fabrics $W_1$, $W_2$ or $W_3$, $W_4$ are associated. For the index j, the following applies: j=1, 2. For the respective summed weight per unit area $G_j$, the following applies preferably: 50 g/m$^2$≤$G_j$≤500 g/m$^2$, in particular 75 g/m$^2$≤$G_j$≤450 g/m$^2$, and in particular 100 g/m$^2$≤$G_j$≤400 g/m$^2$. The weights per unit area $G_j$ may be the same and/or different. The weights per unit area of the individual fabrics $W_i$ may be the same and/or different.

The mode of operation and the use of the grinding disc 1 are as follows:

The additional fabrics $W_1$ to $W_4$ reinforce and stiffen the grinding disc 1 so that the grinding disc 1 can be operated at a comparatively higher rotational speed and a higher cutting speed v during rough machining and/or cutting off. The cutting speed v is at least 80 m/s, in particular at least 90 m/s, and in particular at least 100 m/s at the outer circumference of the grinding disc 1 or at the grinding layer diameter $D_S$. This increases the grinding performance and/or cutting-off performance.

When the grinding disc 1 is designed as a cut-off grinding disc, the additional fabrics $W_1$ to $W_4$ prevent vibration or fluttering at high rotational speeds or high cutting speeds v. When the grinding disc 1 is designed as a cut-off grinding disc, in particular it also allows for a curved cut, as the reinforcing fabric 6 is protected by the fabrics $W_1$ and $W_2$ when it is bent on fastening means of an angle grinding machine.

When the grinding disc 1 is designed as a rough grinding disc, the additional fabrics $W_1$ to $W_4$ enable the number of additional reinforcing fabrics within the grinding layer 2 to be reduced between the reinforcing fabrics 6, 8. This increases the grinding performance with comparable stability and stiffness, as additional reinforcing fabrics in the working region 12 have an adverse effect on the grinding properties or grinding performance. Furthermore, it is possible to make the rough grinding disc comparatively thin so that it can also be used for cutting off. For example, the outer working region 14 can be used for cutting off, whereas the inner working region 13 and additionally the outer working region 14 can be used for rough machining.

In general:

The preferred structure of the grinding disc 1 is label/N—fabric $W_i$/reinforcing fabric 6/grinding layer 2/reinforcing fabric 8/N—fabric $W_i$/label/clamping ring 10. The grinding disc 1 can be configured in a cranked manner in the clamping region 11. The additional fabrics $W_i$ may be finer-meshed and/or coarser-meshed and/or of the same mesh size as the first reinforcing fabric 6 and/or the second reinforcing fabric 8.

The invention claimed is:

1. A grinding disc comprising:

a grinding layer, having a grinding layer diameter, the grinding layer comprising grinding grains bound by a binding agent, and forming a first outer side and a second outer side of the grinding disc, a first reinforcing fabric, which is embedded inside the first outer side of the grinding layer such that the first outer side comprises a first surface of the grinding disc, and which has a first fabric diameter, wherein the first fabric diameter is larger than or equal to 80% of the grinding layer diameter, a second reinforcing fabric, which is embedded inside the second outer side of the grinding layer such that the second outer side comprises a second surface of the grinding disc, and which has a second fabric diameter, wherein the second fabric diameter is larger than or equal to 80% of the grinding layer diameter, wherein at least one fabric is arranged on at least one of the first reinforcing fabric or the second reinforcing fabric, wherein the at least one fabric is embedded in the grinding layer between the first outer side and the second outer side, wherein the at least one fabric has a respective fabric diameter, wherein the at least one fabric diameter is smaller than the first fabric diameter, and the at least one fabric diameter is smaller than the second fabric diameter, wherein the at least one fabric has a respective value Ri, wherein the respective value Ri is larger than or equal to 0.2 and the respective value Ri is less than or equal to 1.2, wherein the following applies to Ri:

$$R_i=R_{xi}+R_{yi},$$

with $$R_{xi}=b_{xi}\cdot n_{xi}/l_{xi},$$

$$R_{yi}=b_{yi}\cdot n_{yi}/l_{yi},$$

wherein $b_{xi}$, $b_{yi}$ is a thread width or a web width of threads in a x-direction and a y-direction, respectively, $n_{xi}$, $n_{yi}$ is a number of threads or a number of webs in the x-direction and the y-direction, respectively, and $l_{xi}$, $l_{yi}$ is a length in the x-direction and the y-direction.

2. The grinding disc according to claim 1, wherein no internal reinforcing fabric is arranged in the grinding layer between the first reinforcing fabric and the second reinforcing fabric.

3. The grinding disc according to claim 1, wherein the at least one fabric is arranged relative to the at least one of the first or second reinforcing fabrics on a side facing away from the grinding layer.

4. The grinding disc according to claim 1, wherein the at least one fabric is arranged on the first reinforcing fabric and at least one fabric is arranged on the second reinforcing fabric.

5. The grinding disc according to claim 1, wherein the at least one fabric comprises a plurality of fabrics arranged on at least one of the first or second reinforcing fabrics.

6. The grinding disc according to claim 1, wherein the at least one fabric diameter is larger than or equal to 25% of the grinding layer diameter, and the at least one fabric diameter is less than or equal to 75% of the grinding layer diameter.

7. The grinding disc according to claim 1, wherein the at least one fabric is arranged in a clamping region and in an inner working region, which is usable for rough machining, and wherein the at least one fabric is arranged outside an outer working region, which is usable for cutting.

8. The grinding disc according to claim 7, wherein the at least one fabric delimits a reinforced region of the grinding disc from an unreinforced region of the grinding disc, wherein the at least one fabric is arranged in the reinforced region, wherein the clamping region and the inner working region form the reinforced region, and wherein the outer working region forms the unreinforced region.

9. The grinding disc according to claim 1, wherein the at least one fabric delimits a reinforced region of the grinding disc with a first thickness and an unreinforced region of the grinding disc with a second thickness, wherein a ratio between the first thickness and the second thickness is between 0.95 and 1.05.

10. The grinding disc according to claim 1, having a grinding disc thickness, wherein the grinding disc thickness is larger than or equal to 2 mm and less than or equal to 7 mm.

11. The grinding disc according to claim 1, having a grinding disc thickness, wherein the grinding disc thickness is larger than or equal to 0.8 mm and less than or equal to 4 mm.

12. The grinding disc according to claim 1, wherein the at least one fabric arranged on the at least one of the first or second reinforcing fabrics has, in total, a respective weight per unit area, wherein the respective weight per unit area is larger than or equal to 50 g/m$^2$, and the respective weight per unit is less than or equal to 500 g/m$^2$.

13. The grinding disc according to claim 1, wherein the at least one fabric has a respective thread width, wherein the respective thread width is larger than or equal to 0.1 mm and the respective thread width is less than or equal to 1.8 mm.

14. The grinding disc according to claim 1, comprising a clamping ring for clamping the grinding disc on a grinding machine.

15. A method of at least one of rough machining and cutting off, the method comprising using the grinding disc according to claim 1, wherein a cutting speed is at least 80 m/s.

16. The grinding disc according to claim 1, wherein the at least one fabric is arranged on the first reinforcing fabric and at least one fabric is arranged on the second reinforcing fabric, and wherein the at least one fabric delimits a reinforced region of the grinding disc with a first thickness and an unreinforced region of the grinding disc with a second thickness, wherein a ratio between the first thickness and the second thickness is between 0.95 and 1.05.

17. A grinding disc comprising:

a grinding layer, having a grinding layer diameter, the grinding layer comprising grinding grains bound by a binding agent, and forming a first outer side and a second outer side of the grinding disc, a first reinforcing fabric embedded inside in the grinding layer on the first outer side of the grinding layer such that the first outer side comprises a first surface of the grinding disc, the first reinforcing fabric having a first fabric diameter, wherein the first fabric diameter is larger than or equal to 80% of the grinding layer diameter, a second reinforcing fabric embedded inside in the grinding layer on the second outer side of the grinding layer such that the second outer side comprises a second surface of the grinding disc, the second reinforcing fabric having a second fabric diameter, wherein the second fabric diameter is larger than or equal to 80% of the grinding layer diameter, wherein at least one fabric is arranged on at least one of the first reinforcing fabric or the second reinforcing fabric, wherein the at least one fabric is embedded in the grinding layer between the first outer side and the second outer side of the grinding layer, wherein the at least one fabric has a respective fabric diameter, wherein the at least one fabric diameter is smaller than the first fabric diameter, and the at least one fabric diameter is smaller than the second fabric diameter, wherein the at least one fabric is arranged in a clamping region and in an inner working region of the grinding disc, wherein the inner working region is usable for rough grinding, wherein the at least one fabric is not arranged in an outer working region of the grinding disc, and wherein the outer working region is usable for cutting.

18. The grinding disc according to claim 17, wherein the grinding disc forms the clamping region and a working region surrounding the clamping region, wherein the working region is divided in a radial direction to an axis of rotation into the inner working region and the outer working region surrounding the inner working region.

19. The grinding disc according to claim 17, wherein the at least one fabric diameter is larger than or equal to 35% of the grinding layer diameter, and the at least one fabric diameter is less than or equal to 70% of the grinding layer diameter.

20. The grinding disc according to claim 17, wherein the at least one fabric is arranged on the first reinforcing fabric and at least one fabric is arranged on the second reinforcing fabric.

21. The grinding disc according to claim 17, wherein the at least one fabric delimits a reinforced region of the grinding disc with a first thickness and an unreinforced region of the grinding disc with a second thickness, wherein a ratio between the first thickness and the second thickness is between 0.95 and 1.05.

22. The grinding disc according to claim 17, wherein the at least one fabric is arranged on the first reinforcing fabric and at least one fabric is arranged on the second reinforcing fabric, and wherein the at least one fabric delimits a reinforced region of the grinding disc with a first thickness and an unreinforced region of the grinding disc with a second thickness, wherein a ratio between the first thickness and the second thickness is between 0.95 and 1.05.

23. The grinding disc according to claim 17, wherein the at least one fabric delimits a reinforced region of the grinding disc from an unreinforced region of the grinding disc, wherein the at least one fabric is arranged in the reinforced region, wherein the clamping region and the inner working region form the reinforced region, and wherein the outer working region forms the unreinforced region.

* * * * *